US011119422B2

(12) United States Patent
Sumioka

(10) Patent No.: US 11,119,422 B2
(45) Date of Patent: Sep. 14, 2021

(54) TONER

(71) Applicant: KYOCERA Document Solutions Inc., Osaka (JP)

(72) Inventor: Sho Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/687,978

(22) Filed: Nov. 19, 2019

(65) Prior Publication Data

US 2020/0174389 A1 Jun. 4, 2020

(30) Foreign Application Priority Data

Nov. 29, 2018 (JP) ..... JP2018-223301

(51) Int. Cl.
*G03G 9/087* (2006.01)
*G03G 9/08* (2006.01)

(52) U.S. Cl.
CPC ..... *G03G 9/0825* (2013.01); *G03G 9/0819* (2013.01); *G03G 9/08711* (2013.01); *G03G 9/08755* (2013.01); *G03G 9/08793* (2013.01)

(58) Field of Classification Search
CPC . G03G 9/0825; G03G 9/08793; G03G 9/0819
See application file for complete search history.

(56) References Cited

U.S. PATENT DOCUMENTS 5,981,129 A * 11/1999 Akazawa ..... G03G 9/081 430/110.2
8,703,374 B2 * 4/2014 Sweeney ..... G03G 9/09335 430/108.11
2006/0160007 A1 * 7/2006 Kmiecik-Lawrynowicz ..... G03G 9/0806 430/108.3
2018/0024454 A1 * 1/2018 Ojima ..... G03G 9/0825 430/108.1
2018/0143549 A1 * 5/2018 Takemori ..... G03G 9/09328

FOREIGN PATENT DOCUMENTS

JP 2007079486 A 3/2007

* cited by examiner

*Primary Examiner* — Christopher D Rodee
(74) *Attorney, Agent, or Firm* — Studebaker & Brackett PC

(57) ABSTRACT

A toner includes toner particles. The toner particles each include a toner mother particle containing a binder resin and an external additive. The external additive includes resin particles. The toner mother particles have a chargeability opposite to a chargeability of the resin particles. Each of the resin particles has an embedded portion embedded in a surface portion of the toner mother particle and a protruding portion protruding outward from the toner mother particle in a radial direction of the toner mother particle. In a cross section of the resin particle, a relationship $0.60 \leq L_A/(L_A+L_B) \leq 0.80$ is satisfied where $L_A$ represents a maximum length of the embedded portion in the radial direction of the toner mother particle and $L_B$ represents a maximum length of the protruding portion in the radial direction of the toner mother particle.

7 Claims, 2 Drawing Sheets

TONER

INCORPORATION BY REFERENCE

The present application claims priority under 35 U.S.C. § 119 to Japanese Patent Application No. 2018-223301, filed on Nov. 29, 2018. The contents of this application are incorporated herein by reference in their entirety.

BACKGROUND

The present disclosure relates to a toner.

A toner has been known that includes toner particles and fine resin particles as an external additive of the toner particles.

SUMMARY

A toner according to an aspect of the present disclosure includes toner particles. The toner particles each include a toner mother particle containing a binder resin and an external additive attached to the toner mother particle. The external additive includes resin particles. The toner mother particles have a chargeability opposite to a chargeability of the resin particles. Each of the resin particles has an embedded portion embedded in a surface portion of the toner mother particle and a protruding portion protruding outward from the toner mother particle in a radial direction of the toner mother particle. In a cross section of the resin particle, a relationship $0.60 \leq L_A/(L_A+L_B) \leq 0.80$ is satisfied where $L_A$ represents a maximum length of the embedded portion in the radial direction of the toner mother particle and $L_B$ represents a maximum length of the protruding portion in the radial direction of the toner mother particle. A relationship $|SP_T-SP_E| \geq 0.6$ $(cal/cm^3)^{1/2}$ is satisfied where $SP_T$ represents an SP value of the binder resin contained in the toner mother particles and $SP_E$ represents an SP value of a resin constituting the resin particles.

DETAILED DESCRIPTION

Figure 1:
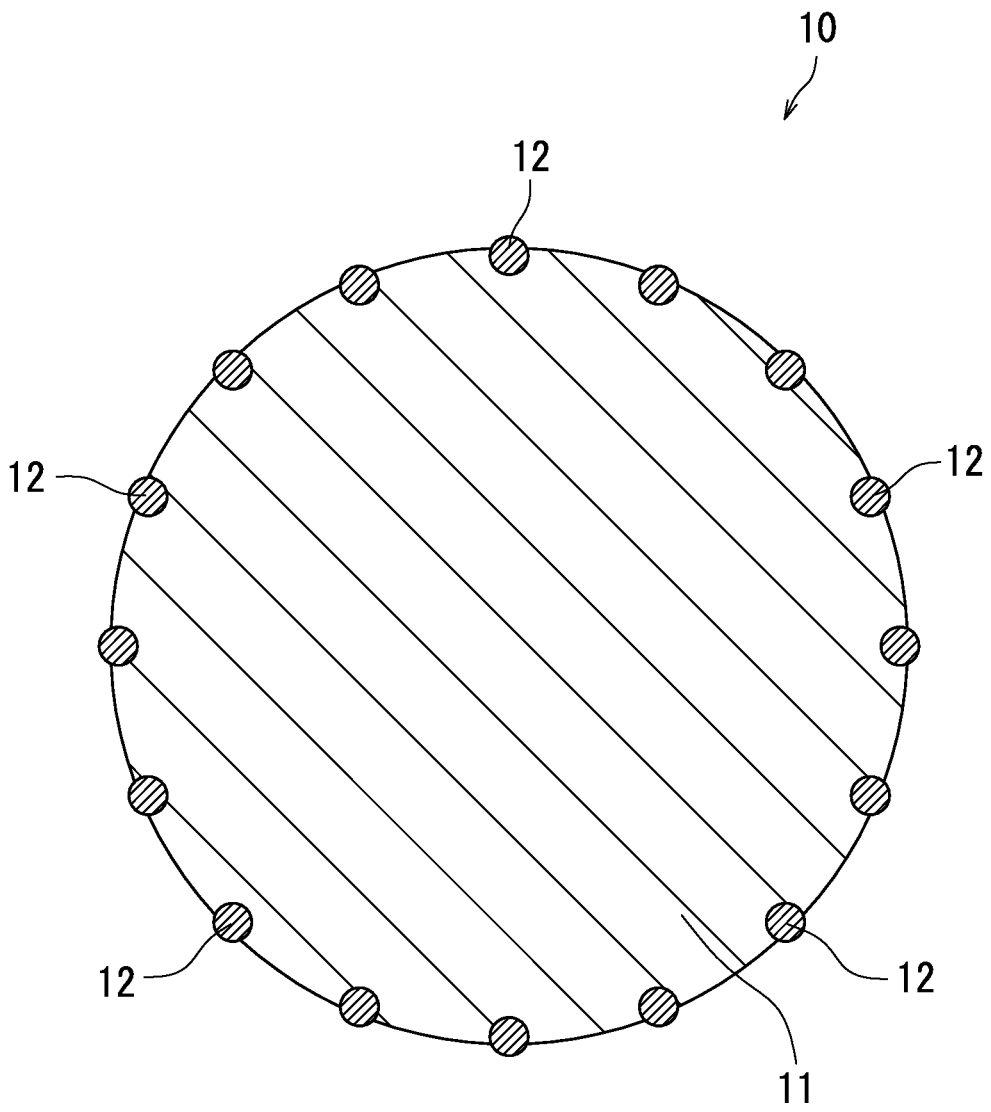
FIG. 1 is a diagram illustrating an example of a sectional structure of a toner particle included in a toner according to an embodiment of the present disclosure.

The following describes a preferable embodiment of the present disclosure. First, the terminology used in the present specification will be described. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles and a powder of external additive particles) are each a number average of values measured for a suitable number of particles selected from the powder.

A value for volume median diameter ($D_{50}$) of a powder is a median of diameter by volume measured using a laser diffraction/scattering particle size distribution analyzer ("LA-950", product of Horiba, Ltd.), unless otherwise stated. A value for number average primary particle diameter of a powder is a number average of equivalent circle diameters of 100 primary particles (Heywood diameter: diameters of circles having the same areas as projected areas of the primary particles) measured using a scanning electron microscope ("JSM-7401F", product of JEOL Ltd.) and image analysis software ("WinROOF", product of MITANI CORPORATION), unless otherwise stated. Note that a number average primary particle diameter of particles refers to a number average primary particle diameter of particles in a powder (number average primary particle diameter of the powder), unless otherwise stated.

A level of chargeability refers to a level of susceptibility to triboelectric charging, unless otherwise stated. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after the triboelectric charging using for example a compact draw-off charge measurement system ("MODEL 212HS", product of TREK, INC.). A measurement target having a larger change in amount of charge before and after the triboelectric charging has stronger chargeability.

A material being positively chargeable (or a material having a positive 1.0 chargeability) means that a value of an amount of charge obtained by measuring the material as a target material (for example, a powder) mixed and stirred with the standard carrier "P-01" for a positively chargeable toner provided by The Imaging Society of Japan is a positive value.

A material being negatively chargeable (or a material having a negative chargeability) means that a value of an amount of charge obtained by measuring the material as a target material (for example, a powder) mixed and stirred with the standard carrier "N-01" for a negatively chargeable toner provided by The Imaging Society of Japan is a negative value.

A value for a softening point (Tin) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) plotted using a differential scanning calorimeter ("DSC-6220", product of Seiko Instruments Inc.), unless otherwise stated. Such an endothermic peak results from melting of a crystalline region. A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection caused due to glass transition (specifically, a temperature at an intersection point between an extrapolation of a base line and an extrapolation of an inclined portion of the curve) corresponds to the glass transition point (Tg).

A value for SP value (solubility parameter) is a parameter defined by an expression "SP value=$(E/V)^{1/2}$" (E: aggregation energy [cal/mol], V: molar volume [$cm^3$/mol]), and is a value (unit: $(cal/cm^3)^{1/2}$, temperature: 25° C.) calculated in accordance with a calculation method of Fedors, unless otherwise stated. Note that the calculation method of Fedors is described in detail in R. F. Fedors, 1974, "Polymer Engineering and Science". Vol. 14, Second, pp. 147-154.

A value for roundness (=perimeter of a circle having the same area as a projected area of a particle/perimeter of the particle) is a number average of values measured for an appropriate number of (for example, 3,000) particles using a flow particle imaging analyzer ("FPIA (registered Japanese trademark)-3000", product of Sysmex Corporation), unless otherwise stated.

A level of hydrophobicity can be expressed for example by a contact angle of a water drop (wettability of water). A larger contact angle of a water drop indicates stronger hydrophobicity.

A cross-linked resin refers to a resin having a cross-linked structure. Cross-linked resin particles refer to resin particles of which constitutional resin is a cross-linked resin. A resin base refers to a non-treated resin particle (a resin particle to which no surfactant is attached, for example). A cross-linked resin base refers to a non-treated cross-linked resin particle (a cross-linked resin particle to which no surfactant is attached, for example).

In the present specification, both a resin base and a resin base to which a surfactant is attached may each be referred to as a "resin particle". In the present specification, both a cross-linked resin base and a cross-linked resin base to which a surfactant is attached may each be referred to as a "cross-linked resin particle".

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term encompassing both acryl and methacryl. The term "(meth)acrylonitrile" may be used as a generic term encompassing both acrylonitrile and methacrylonitrile.

<Toner>

A toner according to the present embodiment is suitable for example for use as a positively chargeable toner in electrostatic latent image development. The toner according to the present embodiment is a collection (for example, a powder) of toner particles (particles each having composition described later). The toner may be used as a one-component developer. Alternatively, the toner may be mixed with a carrier using a mixer (for example, a ball mill) to prepare a two-component developer.

The toner particles included in the toner according to the present embodiment each include a toner mother particle containing a binder resin and an external additive attached to the toner mother particle. The external additive includes resin particles. The toner mother particles have a chargeability opposite to the chargeability of the resin particles. Each of the resin particles includes an embedded portion embedded in a surface portion of the toner mother particle and a protruding portion protruding outward from the toner mother particle in a radial direction of the toner mother particle. In a cross section of the resin particle, a relationship $0.60 \leq L_A/(L_A+L_B) \leq 0.80$ is satisfied where $L_A$ represents a maximum length of the embedded portion in the radial direction of the toner mother particle and $L_B$ represents a maximum length of the protruding portion in the radial direction of the toner mother particle. In the following, $L_A/(L_A+L_B)$ may be referred to as an embedment ratio. The embedment ratio is measured according to the same method as described below in association with Examples or a method conforming therewith.

Furthermore, in the toner according to the present embodiment, a relationship $|SP_T-SP_E| \geq 0.6$ $(cal/cm^3)^{1/2}$ is satisfied where $SP_T$ represents an SP value of the hinder resin contained in the toner mother particles and $SP_E$ represents an SP value of a resin constituting the resin particles. Note that $|SP_T-SP_E|$ is an absolute value of a difference between $SP_T$ and $SP_E$. In the following, $|SP_T-SP_E|$ may be referred to as a ΔSP value.

As a result of having the above composition also referred Lo below as basic composition), the toner according to the present embodiment is excellent in charge stability and heat-resistant preservability. Reasons therefor are thought to be as follows.

The toner according to the present embodiment has a ΔSP value of at least 0.6 $(cal/cm^3)^{1/2}$, and therefore, an excessive increase in compatibility between the toner mother particles and the resin particles can be suppressed in a high-temperature environment. In addition, the toner according to the present embodiment has an embedment ratio of no greater than 0.80. Accordingly, the resin particles of the toner according to the present embodiment can satisfactorily perform a function as a spacer between the toner mother particles even in a high-temperature environment. Thus, agglomeration of the toner mother particles can be inhibited even in a high-temperature environment, and accordingly, the toner according to the present embodiment is excellent in heat-resistant preservability.

The toner according to the present embodiment has an embedment ratio of at least 0.60. In addition, the toner mother particles of the toner according to the present embodiment have a chargeability opposite to the chargeability of the resin particles. Therefore, detachment of the resin particles from the toner mother particles in a development device can be inhibited in the toner according to the present embodiment. As a result of detachment of the resin particles from the toner mother particles being inhibited, carrier contamination (a phenomenon in which foreign mater adheres to carrier particles) hardly occurs in the development device. Thus, impairment of charging ability (performance of toner charging) of a carrier can be inhibited. Thus, the toner according to the present embodiment is excellent in charge stability. Note that when carrier contamination occurs, charging ability of the carrier tends to be impaired.

In order that the toner is suitable for image formation in the present embodiment, the toner mother particles preferably have a volume median diameter ($D_{50}$) of at least 4 μm and no greater than 9 μm.

In order to impart further excellent charge stability and heat-resistant preservability to the toner in the present embodiment, the resin particles preferably have a number average primary particle diameter of at least 60 nm and no greater than 140 nm, more preferably have a number average primary particle diameter of at least 80 nm and no greater than 120 nm, and further preferably have a number average primary particle diameter of at least 90 nm and no greater than 110 nm.

In order to impart further excellent charge stability and heat-resistant preservability to the toner in the present embodiment, the amount of the resin particles is preferably at least 0.2 parts by mass and no greater than 1.0 parts by mass relative to 100 parts by mass of the toner mother particles, more preferably at least 0.3 parts by mass and no greater than 1.0 parts by mass, and further preferably at least 0.3 parts by mass and no greater than 0.5 parts by mass.

In order to impart further excellent charge stability and heat-resistant preservability to the toner in the present embodiment, the binder resin contained in the toner mother particles preferably has an SP value ($SP_T$) of at least 8.0 $(cal/cm^3)^{1/2}$ and no greater than 11.0 $(cal/cm^3)^{1/2}$. For the same purpose as above, the resin constituting the resin particles preferably has an SP value ($SP_E$) of at least 8.0 $(cal/cm^3)^{1/2}$ and no greater than 11.0 $(cal/cm^3)^{1/2}$. Each of $SP_T$ and $SP_E$ can be adjusted by changing either or both types of monomers used for synthesis of the resin and a molar ratio of the monomers used for synthesis of the resin.

In order to further inhibit detachment of the resin particles from the toner mother particles and impart further excellent charge stability to the toner in the present embodiment, the ASP value is preferably no greater than 0.8 $(cal/cm^{-3})^{1/2}$.

The toner mother particles in the present embodiment may further contain an internal additive (for example, at least one of a colorant, a releasing agent, a charge control agent, and a magnetic powder) as necessary in addition to the binder resin.

The following describes the toner according to the present embodiment in detail with reference to the accompanying drawings as appropriate. The drawings schematically illustrate elements of configuration in order to facilitate understanding. Properties such as size and shape and the number of the elements of configuration illustrated in the drawings may differ from actual properties and the number thereof in order to facilitate preparation of the drawings.

[Structure of Toner Particle]

Figure 2:
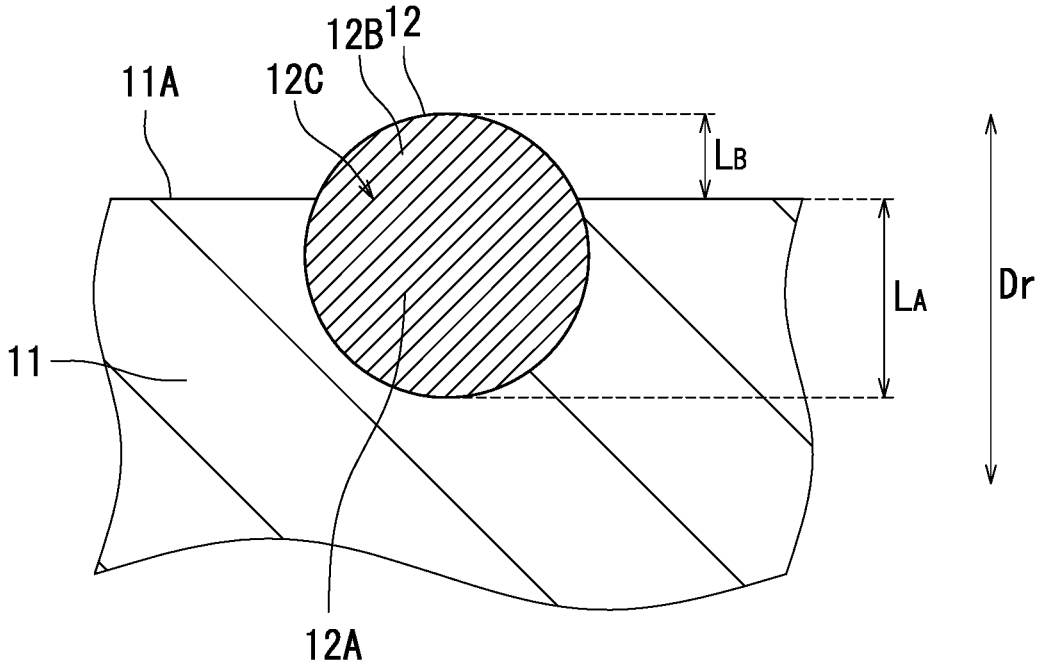
FIG. 2 is an enlarged partial view of a surface layer portion in the cross section of the toner particle illustrated in FIG. 1.

The following describes an example of structure of a toner particle included in the toner according to the present embodiment with reference to FIGS. 1 and 2. FIG. 1 is a diagram illustrating an example of a sectional structure of a toner particle included in the toner according to the present embodiment. FIG. 2 is an enlarged partial view of a surface layer portion in the cross section of the toner particle illustrated in FIG. 1.

A toner particle 10 illustrated in FIG. 1 includes a toner mother particle 11 containing a binder resin and an external additive attached to the toner mother particle 11. The external additive includes resin particles 12.

The toner mother particles 11 have a chargeability opposite to the chargeability of the resin particles 12. In order that the toner mother particles 11 have a chargeability opposite to the chargeability of the resin particles 12, it is preferable that the toner mother particles 11 and the resin particles 12 are constituted by respective materials different in chargeability from each other. For example, when a material having a negative chargeability (negatively chargeable material) is used as a constitutional material of the toner mother particles 11 while a material having a positive chargeability (positively chargeable material) is used as a constitutional material of the resin particles 12, a combination of negatively chargeable toner mother particles 11 and positively chargeable resin particles 12 can be obtained. By contrast, when a positively chargeable material is used as a constitutional material of the toner mother particles 11 while a negatively chargeable material is used as a constitutional material of the resin particles 12, a combination of positively chargeable toner mother particles 11 and negatively chargeable resin particles 12 can be obtained.

Examples of positively chargeable materials include materials having cationic functional groups. Examples of cationic functional groups include an amino group, a quaternary ammonium cation group, an amide group, and nitrogen-containing heterocyclic groups. Examples of nitrogen-containing heterocyclic groups include a pyridine ring group, a pyrazine ring group, a pyridazine ring group, a pyrimidine ring group, and a triazine ring group. A positively chargeable charge control agent can also be used as a positively chargeable material.

Examples of negatively chargeable materials include materials having anionic functional groups. Examples of anionic functional groups include an ester group, a hydroxy group, an ether group, and acid groups (a specific example is a carboxy group). A negatively chargeable charge control agent can also be used as a negatively chargeable material.

The resin particles 12 may each include a resin base (not illustrated) and a cationic surfactant (not illustrated) attached to a surface of the resin base. The cationic surfactant is an example of a positively chargeable material. In this case, the resin particles 12 tend to have a positive chargeability.

Alternatively, the resin particles 12 may each include a resin base (not illustrated) and an anionic surfactant (not illustrated) attached to a surface of the resin base. The anionic surfactant is an example of a negatively chargeable material. In this case, the resin particles 12 tend to have a negative chargeability.

In order to obtain a positively chargeable toner excellent in charge stability, preferably, the toner mother particles 11 have a negative chargeability while the resin particles 12 have a positive chargeability.

As illustrated in FIG. 2, each of the resin particles 12 includes an embedded portion 12A embedded in a surface portion of the toner mother particle 11 and a protruding portion 12B protruding outward in a radial direction Dr of the toner mother particle 11. The protruding portion 12B is a portion of the resin particle 12 protruding outward from the toner mother particle 11 in the radial direction Dr of the toner mother particle 11 from a level of a surface region of the toner mother particle 11 to which no resin particles 12 are attached (for example, a level of a surface region 11A in FIG. 2). The relationship $0.60 \leq L_A/(L_A+L_B) \leq 0.80$ is satisfied in a cross section of the resin particle 12 where $L_A$ represents a maximum length of the embedded portion 12A in the radial direction Dr of the toner mother particle 11 and $L_B$ represents a maximum length of the protruding portion 12B in the radial direction Dr of the toner mother particle 11. Note that $L_A$ represents a maximum length of the embedded portion 12A measured from a boundary 12C between the embedded portion 12A and the protruding portion 12B in the radial direction Dr of the toner mother particle 11. Also, $L_B$ represents a maximum length of the protruding portion 12B measured from the boundary 12C between the embedded portion 12A and the protruding portion 12B in the radial direction Dr of the toner mother particle 11. Although the level of the surface region 11A is indicated by a straight line in FIG. 2, the surface of the toner mother particle 11 is spherical in each of actual toner particles.

Furthermore, the relationship $|SP_T-SP_E|=0.6$ $(cal/cm^3)^{1/2}$ is satisfied where $SP_T$ represents an SP value of the binder resin contained in the toner mother particles 11 and $SP_E$ represents an SP value of the resin constituting the resin particles 12.

An example of the composition of the toner particles included in the toner according to the present embodiment has been described so far with reference to FIGS. 1 and 2.

[Elements of Toner Particles]

The following describes elements of the toner particles included in the toner according to the present embodiment.

(Binder Resin)

The binder resin occupies for example at least 70% by mass of all components of the toner mother particles. Accordingly, properties of the binder resin are thought to have a great influence on overall properties of the toner mother particles. The properties (specific examples include a glass transition point) of the binder resin can be adjusted through use of different resins in combination as the hinder resin.

In order to impart excellent low-temperature fixability to the toner, the toner mother particles preferably contain a thermoplastic resin as the binder resin, and more preferably contain a thermoplastic resin in an amount of at least 85% by mass relative to a total amount of the binder resin. Examples of thermoplastic resins include styrene-based resin, acrylic acid ester-based resin, olefin-based resins (specific examples include polyethylene resin and polypropylene resin), vinyl resins (specific examples include vinyl chloride resin, polyvinyl alcohol, vinyl ether resin, and N-vinyl resin), polyester resin, polyamide resin, and urethane resin. A copolymer of any of the above-listed resins, that is, a copolymer formed through introduction of a repeating unit into any of the above-listed resins (specific examples include styrene-acrylic acid ester-based resin and styrene-butadiene-based resin) can also be used as the binder resin.

A thermoplastic resin can be obtained through addition polymerization, copolymerization, or condensation polymerization of at least one thermoplastic monomer. Note that a thermoplastic monomer is a monomer that forms a thermoplastic resin through homopolymerization (specific examples include acrylic acid ester-based monomers and styrene-based monomers) or a monomer that forms a thermoplastic resin through condensation polymerization (for example, a combination of a polyhydric alcohol and a polybasic carboxylic acid that form a polyester resin through condensation polymerization).

In order to impart excellent low-temperature fixability to the toner, the toner mother particles preferably contain a polyester resin as the binder resin, more preferably contain a polyester resin in an amount of at least 80% by mass and no greater than 100% by mass relative to a total amount of the binder resin, and further preferably contain only a polyester resin as the binder resin. A polyester resin can be obtained through condensation polymerization of at least one polyhydric alcohol and at least one polybasic carboxylic acid. Examples of polyhydric alcohols that can be used for synthesis of a polyester resin include dihydric alcohols (specific examples include aliphatic diols and bisphenols) and tri- or higher-hydric alcohols listed below. Examples of polybasic carboxylic acids that can be used for synthesis of a polyester resin include dibasic carboxylic acids and tri- or higher-basic carboxylic acids listed below. Note that a polybasic carboxylic acid derivative (specific examples include an anhydride of a polybasic carboxylic acid and a halide of a polybasic carboxylic acid) that can form an ester bond through condensation polymerization may be used instead of a polybasic carboxylic acid.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, 1,10-decanedicarboxylic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol trimer acid.

(Colorant)

The toner mother particles may contain a colorant. A known pigment or dye that matches the color of the toner can be used as the colorant. In order to form high-quality images with the toner, the amount of the colorant is preferably at least 1 part by mass and no greater than 20 parts by mass relative to 100 parts by mass of the binder resin.

The toner mother particles may contain a black colorant. Carbon black can for example be used as the black colorant. Alternatively, a colorant adjusted to black color using a yellow colorant, a magenta colorant, and a cyan colorant may be used as a black colorant.

The toner mother particles may contain a non-black colorant. Examples of non-black colorants include yellow colorants, magenta colorants, and cyan colorants.

At least one compound selected from the group consisting of condensed azo compounds, isoindolinone compounds, anthraquinone compounds, azo metal complexes, methine compounds, and arylamide compounds can for example be used as the yellow colorant. Examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and CI Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Examples of magenta colorants include CI Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as the cyan colorant. Examples of cyan colorants include CI Pigment Blue (1, 7, 15, 15:1, 15:2, 15:3, 15:4, 60, 62, or 66), Phthalocyanine Blue, CI Vat Blue, and CI Acid Blue.

(Releasing Agent)

The toner mother particles may contain a releasing agent. The releasing agent may be used in order to impart for example excellent offset resistance to the toner. The amount of the releasing agent is preferably at least 1 part by mass and no greater than 20 parts by mass relative to 100 parts by mass of the binder resin in order to impart excellent offset resistance to the toner.

Examples of releasing agents include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of ester waxes include natural ester waxes (specific examples include carnauba wax and rice wax), and synthetic ester wax. In the present embodiment, one releasing agent may be used independently or two or more releasing agents may be used in combination.

A compatibilizer may be added to the toner mother particles in order to improve compatibility between the binder resin and the releasing agent.

(Charge Control Agent)

The toner mother particles may contain a charge control agent. The charge control agent is used in order to impart for example an excellent charge rise characteristic to the toner. The charge rise characteristic of a toner is an indicator as to whether or not the toner is chargeable to a specific charge level in a short period of time.

As a result of the toner mother particles containing a positively chargeable charge control agent, cationic strength (positive chargeability) of the toner mother particles can be increased. As a result of the toner mother particles containing a negatively chargeable charge control agent by contrast, anionic strength (negative chargeability) of the toner mother particles can be increased.

Examples of positively chargeable charge control agents include: azine compounds such as pyridazine, pyrimidine, pyrazine, 1,2-oxazine, 1,3-oxazine, 1,4-oxazine, 1,2-thiazin, 1,3-thiazine, 1,4-thiazin, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Anne Deep Black 3RL; acid dyes such as Nigrosine BK, Nigrosine NB, and Nigrosine Z; alkoxylated amine; alkylamide; quaternary ammonium salts such as benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt; and a resin having a quaternary ammonium cation group. One of the charge control agents listed above may be used independently, or two or more charge control agents listed above may be used in combination.

Examples of negatively chargeable charge control agents include organic metal complexes, which are chelate compounds. A preferable organic metal complex is at least one selected from the group consisting of metal acetylacetonate complexes, salicylic acid-based metal complexes, and salts of them.

In order to impart an excellent charge rise characteristic to the toner, the amount of the charge control agent is preferably at least 0.1 parts by mass and no greater than 20 parts by mass relative to 100 parts by mass of the binder resin.

(Magnetic Powder)

The toner mother particles may contain a magnetic powder. Examples of materials of the magnetic powder include ferromagnetic metals (specific examples include iron, cobalt, and nickel), alloys of ferromagnetic metals, ferromagnetic metal oxides (specific examples include ferrite, magnetite, and chromium dioxide), and materials subjected to ferromagnetization (specific examples include carbon materials rendered ferromagnetic through thermal treatment). In the present embodiment, one magnetic powder may be used independently or two or more magnetic powders may be used in combination.

(External Additive)

The toner particles included in the toner according to the present embodiment include an external additive attached to the toner mother particles. The external additive includes resin particles as external additive particles. No particular limitations are placed on the resin particles so long as the embedment ratio can be adjusted to a range of at least 0.60 and no greater than 0.80 (also referred to below as a first range) and the ΔSP value can be adjusted to a range of at least 0.6 $(cal/cm^3)^{1/2}$ (also referred to below as a second range). Note that the resin particles may each include a resin base and a surface-treated layer disposed on a surface of the resin base. An example of the surface-treated layer is a surface-treated layer constituted by a surfactant.

In a case where the toner mother particles contain a polyester resin as the binder resin, the resin constituting the resin particles is preferably a cross-linked resin in order to facilitate adjustment of the embedment ratio to the first range.

In a case where the toner mother particles contain a polyester resin as the binder resin and the resin constituting the resin particles is a cross-linked resin, the cross-linked resin is preferably a polymer (also referred to below as a specific cross-linked polymer) of a styrene-based monomer, an acrylic acid-based monomer, and a cross-linking agent having tow or more unsaturated bonds (for example, carbon-to-carbon double bonds) in order to facilitate adjustment of the ΔSP value to the second range. In order to further facilitate adjustment of the ΔSP value in the second range, the cross-linking agent having two or more unsaturated bonds is preferably a cross-linking agent having two carbon-to-carbon double bonds.

Examples of the styrene-based monomer that can be used for synthesis of the specific cross-linked polymer include styrene, alkyl styrenes, hydroxystyrenes, and halogenated styrenes. Examples of alkyl styrenes include a-methylstyrene, m-methylstyrene, p-methylstyrene, p-ethylstyrene, and 4-t-buthylstyrene. Examples of hydroxystyrenes include p-hydroxystyrene and m-hydroxystyrene. Examples of halogenated styrenes include α-chlorostyrene, o-chlorostyrene, m-chlorostyrene, and p-chlorostyrene. In order to facilitate synthesis of the specific cross-linked polymer, styrene is preferable as the styrene-based monomer.

Examples of the acrylic acid-based monomer that can be used for synthesis of the specific cross-linked polymer include (meth)acrylic acid, (meth)acrylarnide, (meth)acrylonitrile, alkyl (meth)acrylates, and hydroxyalkyl (meth) acrylates. Examples of alkyl(meth)acrylates include methyl (meth)acrylate, ethyl(meth)acrylate, n-propyl(meth) acrylate, iso-propyl(meth)acrylate, n-butyl(meth)acryiate, iso-butyl(meth)acrylate, and 2-ethythexyl(meth)acrylate. Examples of hydroxyalkyl(meth)acrylates include 2-hydroxyethyl(meth)acrylate, 3-hydroxypropyl(meth)acrylate, 2-hydroxypropyl(meth)acrylate, and 4-hydroxybutyl(meth) acrylate. In order to facilitate synthesis of the specific cross-linked polymer, the acrylic acid-based monomer is preferably alkyl(meth)acrylate, and more preferably methyl methacrylate.

Examples of the cross-linking agent having two or more unsaturated bonds that can be used for synthesis of the specific cross-linked polymer include N,N'-methylenebisacrylamide, divinylbenzene, ethylene glycol diacrylate, ethylene glycol dimethacrylate, diethylene glycol diacrylate, tetraethylene glycol diacrylate, polyethylene glycol diacrylate, 1,4-butanediol diacrylate, 1,6-hexanediol diacrylate, tripropylene glycol diacrylate, trimethylolpropane triacrylate, pentaerythritol triacrylate, pentaerythritol tetraacrylate, 1,4-butanediol dimethacrylate, and 1,6-hexanediol dimethacrylate.

In order to impart further excellent charge stability and heat-resistant preservability to the toner, the cross-linking agent having two or more unsaturated bonds is preferably ethylene glycol dimethacrylate.

In a case where the toner mother particles contain a polyester resin as the binder resin and the resin constituting the resin particles is a cross-linked resin, the cross-linked resin is preferably a polymer of styrene, alkyl(meth)acrylate, and a cross-linking agent having two or more unsaturated bonds in order to impart further excellent charge stability and heat-resistant preservability to the toner.

In a case where the toner mother particles have a negative chargeability and the resin particles have a positive chargeability in the toner according to the present embodiment, preferably, the resin particles each include a cross-linked resin base and a cationic surfactant attached to a surface of the cross-linked resin base in order to impart further excellent charge stability and heat-resistant preservability to the toner. In the following, the resin particles each including a cross-linked resin base and a cationic surfactant attached to the surface of the cross-linked resin base may be referred to as specific cationic resin particles.

In a case where the specific cationic resin particles are used as the resin particles in the toner according to the present embodiment, it is preferable that the toner mother particles contain only a polyester resin as the binder resin and contain no positively chargeable charge control agent in order to impart further excellent charge stability and heat-resistant preservability to the toner.

The following describes an example of a method for forming the specific cationic resin particles of which constitutional resin is the specific cross-linked polymer. First, polymerization reaction for forming the specific cross-linked polymer is performed in a liquid containing a styrene-based monomer, an acrylic acid-based monomer, a cross-linking agent having two or more unsaturated bonds, and a cationic surfactant. Next, the resultant product is taken out from the liquid after the reaction, and then dried without being washed (or dried after a washing process in which the cationic surfactant remaining on a surface of the product is not thoroughly removed). By the method described above, the specific cationic resin particles are obtained that each include the cross-linked resin base of which constitutional resin is the specific cross-linked polymer, and the cationic surfactant attached to the surface of the cross-linked resin base. The number average primary particle diameter of the specific cationic resin particles can be adjusted for example by changing at least one of the amount of the cross-linking agent, the type of the cationic surfactant, and the amount of the cationic surfactant. The cationic surfactant is preferably a cationic surfactant having a quaternary ammonium cation group, more preferably cetyltrimethylammonium salt, and further preferably cetyltrimethylammonium chloride.

When an anionic surfactant is used instead of the cationic surfactant in the method for forming the specific cationic resin particles, resin particles each including a cross-linked resin base and the anionic surfactant attached to a surface of the cross-linked resin base can be obtained.

Although a suitable method for forming resin particles usable for the toner according to the present embodiment has been described so far, the method for forming the resin particles is not limited specifically. Commercially available product may be used as the resin particles in the present embodiment.

The external additive may include only the resin particles as the external additive particles or further include additional external additive particles in addition to the resin particles. In order to favorably maintain fluidity of the toner, inorganic particles are preferable as the additional external additive particles. Examples of the inorganic particles include silica particles and particles of metal oxides (specific examples include titanic, alumina, magnesium oxide, and zinc oxide).

The additional external additive particles may be subjected to surface treatment. For example, when silica particles are used as the additional external additive particles, surfaces of the silica particles may be rendered hydrophobic and/or positively chargeable through use of a surface treatment agent. Examples of surface treatment agents include coupling agents (specific examples include a silane coupling agent, a titanate coupling agent, and an aluminate coupling agent), silazane compounds (specific examples include a chain silazane compound and a cyclic silazane compound), and silicone oils (specific examples include dimethyl silicone oil). At least one selected from silane coupling agents and silazane compounds is particularly preferable as the surface treatment agent. Examples of preferable silane coupling agents include silane compounds (specific examples include methyltrimethoxysilane and aminosilane). Examples of preferable silazane compounds include hexamethyldisilazane (HMDS). When surfaces of silica bases (untreated silica particles) are treated with a surface treatment agent, all or part of a large number of hydroxyl groups (—OH) present on the surfaces of the silica bases are each replaced with a functional group derived from the surface treatment agent. As a result, silica particles are obtained that have the functional group derived from the surface treatment agent (specifically, a functional group having stronger hydrophobicity and/or stronger positive chargeability than the hydroxyl groups) on the surfaces thereof.

The amount of the external additive (in a case where an additional external additive is used, the total amount of the resin particles and the additional external additive) is preferably at least 0.2 parts by mass and no greater than 10.0 part by mass relative to 100 parts by mass of the toner mother particles in order to allow the external additive to satisfactorily exert its function while inhibiting detachment of the external additive from the toner mother particles.

(Combination of Materials)

In order to impart further excellent charge stability and heat-resistant preservability to the toner, it is preferable that the toner mother particles contain a polyester resin as the binder resin and the resin constituting the resin particles is a polymer of styrene, methyl methacrylate, and ethylene glycol dimethacrylate.

In order to obtain a positively chargeable toner having particularly excellent charge stability and heat-resistant preservability, preferably, the following conditions 1) to 4) are all satisfied.

1) The toner mother particles contain only a polyester resin as the binder resin.

2) The toner mother particles contain no positively chargeable charge control agent.

3) The resin constituting the resin particles is a polymer of styrene, methyl methacrylate, and ethylene glycol dimethacrylate.

4) The resin particles each include a cross-linked resin base and a cationic surfactant attached to a surface of the cross-linked resin base.

<Toner Production Method>

The following describes a suitable method for producing the toner according to the above-described embodiment. Description of elements overlapping with those of the toner according to the embodiment described above is omitted.

[Toner Mother Particle Preparation Process]

First, toner mother particles are prepared by an aggregation method or a pulverization method.

The aggregation method includes an aggregation step and a coalescence step, for example. The aggregation step involves causing fine particles containing components constituting the toner mother particles to aggregate in an aqueous medium to form aggregated particles. The coalescence step involves causing the components included in the aggregated particles to coalesce in the aqueous medium to form toner mother particles.

The following describes the pulverization method. The pulverization method can relatively easily prepare the toner mother particles and reduce manufacturing cost. In a case where the toner mother particles are prepared by the pulverization method, the toner mother particle preparation process includes for example a melt-kneading step and a pulverization step. The toner mother particle preparation process may further include a mixing step before the melt-kneading step. The toner mother particle preparation process may further include, after the pulverization step, at least one of a fine pulverization step and a classification step.

The mixing step involves mixing the binder resin and an internal additive to be added depending on necessity thereof to yield a mixture. In the melt-kneading step, toner materials are melt-kneaded to yield a melt-kneaded substance. The toner materials used are the mixture yielded in the mixing step, for example. In the pulverization step, the resultant melt-kneaded substance is cooled for example to room temperature (25° C.) and then pulverized to yield a pulverized product. In a case where reduction in diameter of the pulverized product as a result of performance of the pulverization step is needed, a step of further pulverizing the pulverized product (fine pulverization step) may be performed. Furthermore, in order to equalize the particle diameter of the pulverized substance, a step of classifying the resultant pulverized substance (classification step) may be performed. Through the above steps, the toner mother particles that are the pulverized product are obtained.

[External Additive Addition]

Thereafter, the resultant toner mother particles and an external additive are mixed together using a mixer to attach the external additive to the toner mother particles. The external additive includes at least resin particles. For example, an FM mixer (product of Nippon Coke & Engineering Co., Ltd.) is used as the mixer. The following describes an example of an external additive addition process in a case where the resin particles and inorganic particles are used as the external additive.

(First Mixing Step)

First, the toner mother particles and the resin particles are mixed together using a mixer to obtain particles also referred to below as resin-externally-added particles) that are the toner mother particles each having a surface to which the resin particles are attached. The embedment ratio can be adjusted by changing at least one of the amount of the resin particles relative to the amount of the toner mother particles, the number average primary particle diameter of the resin particles, and conditions in mixing the toner mother particles and the resin particles (specific examples include a mixing time and a rotational speed).

(Second Mixing Step)

Next, the resin-externally-added particles and the inorganic particles are mixed together using a mixer. Through the mixing, the inorganic particles are attached to surfaces of the toner mother particles of the resin-externally-added particles. Thus, a toner including the toner particles is produced.

EXAMPLES

The following describes examples of the present disclosure. However, the present disclosure is not limited to the scope of the examples.

<Resin Particle Preparation>

[Preparation of Resin Particles P1]

A 1-L four-necked flask equipped with a stirrer, a cooling tube, a thermometer, and a nitrogen inlet tube was charged with 600 g of ion exchanged water, 185 g of styrene,25 g of methyl methacrylate, 10 g of ethylene glycol dimethacrylate, 14 g of a cationic surfactant (cetyltrimethylammonium chloride), and 15 g of a polymerization initiator (benzoyl peroxide) under stirring. The molar ratio (St:MMA:EGDMA) of styrene (St), methyl methacrylate (MMA), and ethylene glycol dimethacrylate (EGDMA) thus charged was 35:5:1.

Subsequently, nitrogen gas was introduced into the flask while the flask contents were stirred to change the inner atmosphere of the flask to a nitrogen atmosphere. The temperature of the flask contents was then increased to 90° C. in the nitrogen atmosphere while the flask contents were stirred. Thereafter, the flask contents were caused to react (specifically, polymerization reaction) for 3 hours under stirring in the nitrogen atmosphere at a temperature of 90° C. to yield an emulsion including a reaction product (resin particles). Next, the resultant emulsion was cooled for solid-liquid separation and the resultant solid was dried at a temperature of 80° C. for 18 hours to obtain a powder of resin particles P1 having a number average primary particle diameter of 100 nm. Note that the same result was obtained as above when the number average primary particle diameter of a powder of the resin particles P1 after production of a toner by the later-described method and separation of the resin particles P1 from toner particles of the thus produced toner was measured as a measurement target. The same results were obtained as above for the number average primary particle diameters of respective powders of resin particles P2 to P4 described later.

The resin particles P1 had a softening point (Tm) of 100° C., a glass transition point (Tg) of 50° C., and an SP value of a constitutional resin thereof of 9.9 $(cal/cm^3)^{1/2}$. Resin bases of the resin particles P1 are constituted by a resin (cross-linked resin) having a structure cross-linked by ethylene glycol dimethacrylate as a cross-linking agent. That is, the resin particles P1 were cross-linked particles. The resin particles P1 each included a cross-linked resin base constituted by a polymer of styrene, methyl methacrylate, and ethylene glycol dimethacrylate, and a cationic surfactant attached to a surface of the cross-linked resin base.

[Preparation of Resin Particles P2]

The resin particles P2 were prepared by the same method as that for preparing the resin particles P1 in all aspects other than that the amounts of styrene (St) and methyl methacrylate (MMA) added into the flask were changed to 65 g and 145 g, respectively. The molar ratio (St:MMA:EGDMA) of styrene (St), methyl methacrylate (MMA), and ethylene glycol dimethacrylate (EGDMA) thus charged was 12:28:1.

The resin particles P2 had an SP value of the constitutional resin of 9.3 $(cal/cm^3)^{1/2}$ and a number average primary particle diameter of 100 nm. Resin bases of the resin particles P2 were constituted by a resin (cross-linked resin) having a structure cross-linked by ethylene glycol dimethacrylate as a cross-linking agent. That is, the resin particles P2 were cross-linked resin particles. The resin particles P2 each included a cross-linked resin base constituted by a polymer of styrene, methyl methacrylate, and ethylene glycol dimethacrylate, and a cationic surfactant attached to a surface of the cross-linked resin base.

[Preparation of Resin Particles P3]

The resin particle P3 were prepared by the same method as that for preparing the resin particles P1 in all aspects other than that the amounts of styrene (St) and methyl methacrylate (MMA) added into the flask were changed to 159 g and 51 g, respectively. The molar ratio (St:MMA:EGDMA) of styrene (St), methyl methacrylate (MMA), and ethylene glycol dimethacrylate (EGDMA) thus charged was 30:10:1.

The resin particles P3 had an SP value of the constitutional resin of 9.8 $(cal/cm^3)^{1/2}$ and a number average primary particle diameter of 100 nm. Resin bases of the resin particles P3 were constituted by a resin (cross-linked resin) having a structure cross-linked by ethylene glycol dimethacrylate as a cross-linking agent. That is, the resin particles P3 were cross-linked resin particles. The resin particles P3 each included a cross-linked resin base constituted by a polymer of styrene, methyl methacrylate, and ethylene glycol dimethacrylate, and a cationic surfactant attached to a surface of the cross-linked resin base.

[Preparation of Resin Particles P4]

The resin particles P4 were produced by the same method as that for preparing the resin particles P1 in all aspects other than that 14 g of an anionic surfactant (sodium dodecylbenzenesulfonate) was used instead of 14 g of the cationic surfactant (cetyltrimethylammonium chloride) and 15 g of a polymerization initiator (ammonium persulfate) was used instead of 15 g of the polymerization initiator (benzoyl peroxide).

The resin particles P4 had an SP value of the constitutional resin of 9.9 $(cal/cm^3)^{1/2}$ and a number average primary particle diameter of 100 nm. Resin bases of the resin particles P4 were constituted by a resin cross-linked resin) having a structure cross-linked by ethylene glycol dimethacrylate as a cross-linking agent. That is, the resin particles P4 were cross-linked resin particles. The resin particles P4 each included a cross-linked resin base constituted by a polymer of styrene, methyl methacrylate, and ethylene glycol dimethacrylate, and an anionic surfactant attached to a surface of the cross-linked resin base.

<Determination of Charge Polarity of Resin Particles>

In an environment at a temperature of 25° C. and a relative humidity of 50%, 100 parts by mass of a standard carrier provided by The Imaging Society of Japan and 7 parts by mass of a sample (one type of the resin particles P1 to P4) were mixed and agitated for 30 minutes at a rotational speed of 96 rpm using a mixer (TURBULA (registered Japanese trademark) MIXER T2F", product of Willy A. Bachofen AG (WAB)). Subsequently, the amount of charge of the sample in the resultant mixture was measured using a compact toner draw-off charge measurement system ("MODEL 212HS", product of TREK, INC.) in an environment at a temperature of 25° C. and a relative humidity of 50%. The standard carrier used for each type of the resin particles P1 to P3 was a standard carrier "P-01" for a positively chargeable toner. The standard carrier used for the resin particles P4 was a standard carrier "N-01" for a negatively chargeable toner.

An amount of charge of each type of the resin particles P1 to P3 measured by the above measuring method was a positive value. Therefore, the resin particles P1 to P3 had a positive chargeability. The amount of charge of the resin particles P4 measured by the above measuring method was a negative value. Therefore, the resin particles P4 had a negative chargeability.

<Toner Mother Particle Preparation>

[Preparation of Toner Mother Particles M1]

A polyester resin having an SP value of 9.3 $(cal/cm^3)^{1/2}$ was obtained as a binder resin through reaction between 1,6-hexanediol and sebacic acid. The molar ratio (1,6-hexanediol:sebacic acid) between 1,6-hexanediol and sebacic acid used in the reaction was 4:1. Next, 100 parts by mass of the resultant polyester resin, 5 parts by mass of a colorant (C.I. Pigment Blue 15:3, component: copper phthalocyanine pigment), and 5 parts by mass of an ester wax ("NISSAN ELECTOL (registered Japanese trademark) WEP-3", product of NOF Corporation, melting point: 73° C.) were mixed together using a FM mixer having a capacity of 10 L ("FM-10C/I", product of Nippon Coke & Engineering Co., Ltd.).

Subsequently, the resultant mixture was melt-kneaded using a twin-screw extruder ("PCM-30", product of Ikegai Corp.). The resultant melt-kneaded substance was cooled while being rolled to obtain kneaded chips. Subsequently, the resultant kneaded chips were pulverized using a pulverizer ("TURBO MILL T250", product of FREUND-TURBO CORPORATION) under a condition of a set particle diameter of 5.6 μm. Subsequently, the resultant pulverized product was classified using a classifier ("ELBOW JET TYPE EJ-LABO", product of Nittetsu Mining Co., Ltd.). Through the above, toner mother particles M1 were obtained that had a volume median diameter ($D_{50}$) of 6.0 μm, a roundness of 0.931, a glass transition point (Tg) of 48° C., and a softening point (Tm) of 100° C.

[Preparation of Toner Mother Particles M2]

Toner mother particles M2 were prepared by the same method as that for preparing the toner mother particles M1 in all aspects other than that 100 parts by mass of a polyester resin having an SP value of 9.2$(cal/cm^3)^{1/2}$ was used as a hinder resin. The resultant toner mother particles M2 had a volume median diameter ($D_{50}$) of 6.0 μm, a roundness of 0.931, a glass transition point (g) of 48° C., and a softening point (Tm) of 99° C. The polyester resin having an SP value of 9.2 $(cal/cm^3)^{1/2}$ was obtained through reaction between 1,6-hexanediol and sebacic acid at a molar ratio (1,6-hexanediol:sebacic acid) of 5:1.

[Preparation of Toner Mother Particles M3]

Toner mother particles M3 were prepared by the same method as that for preparing the toner mother particles M1 in all aspects other than that 100 parts by mass of a polyester resin having an SP value of 9.9 $(cal/cm^3)^{1/2}$ was used as a binder resin. The resultant toner mother particles M3 had a volume median diameter ($D_{50}$) of 6.0 μm, a roundness of 0.931, a glass transition point (g) of 48° C., and a softening point (Tm) of 101° C. The polyester resin having an SP value of 9.9 $(cal/cm^3)^{1/2}$ was obtained through reaction between 1,6-hexanediol and sebacic acid at a molar ratio (1,6-hexanediol:sebacic acid) of 1:1.

[Preparation of Toner Mother Particles M4]

Toner mother particles M4 were prepared by the same method as that for preparing the toner mother particles M1 in all aspects other than that 100 parts by mass of a polyester resin having an SP value of 10.7 $(cal/cm^3)^{1/2}$ was used as a binder resin. The resultant toner mother particles M4 had a volume median diameter ($D_{50}$) of 6.0 μm, a roundness of 0.931, a glass transition point (g) of 49° C., and a softening point (Tm) of 99° C. The polyester resin having an SP value of 10.7 $(cal/cm^3)^{1/2}$ was obtained through reaction between bisphenol A ethylene oxide adduct (average number of moles added of ethylene oxide: 2 mol), terephthalic acid, and trimellitic anhydride in the presence of a titanium oxide catalyst. The molar ratio of monomers used in the reaction (bisphenol A ethylene oxide adduct:terephthalic acid:trimellitic anhydride) was 75:20:5.

<Determination of Charge Polarity of Toner Mother Particles>

A charge polarity of each type of the prepared toner mother particles M1 to M4 were determined by the same method as that for determining a charge polarity of the resin particles as described above. Each type of the toner mother particles M1 to M4 had a negative value as an amount of charge after mixing and stirring with the standard carrier "N-01" for a negatively chargeable toner. Therefore, each type of the toner mother particles M1 to M4 had a negative chargeability.

<Production of Toner TA-1>

[First Mixing Step]

Using a 5-L FM mixer (product of Nippon Coke & Engineering Co., Ltd.), 100 parts by mass of the toner mother particles M1 and 0.4 parts by mass of the resin particles P1 were mixed together for 24.0 minutes under conditions of a rotational speed of 3,000 rpm and a jacket temperature of 20° C. to obtain resin-externally-added particles, which were toner mother particles M1 each having a surface to which the resin particles P1 were attached. The resultant resin-externally-added particles included 100 parts by mass of the toner mother particles M1 and 0.4 parts by mass of the resin particles P1.

[Second Mixing Step]

Subsequently, 100 parts by mass of the resin-externally-added particles obtained by the first mixing step and 0.4 parts by mass of positively chargeable silica particles ("AEROSIL (registered Japanese trademark) REA90", product of Nippon Aerosil Co., Ltd., number average primary particle diameter: 20 nm) were mixed together for 30 seconds under conditions of a rotational speed of 3,000 rpm and a jacket temperature of 20° C. using a 5-L FM mixer (product of Nippon Coke & Engineering Co., Ltd.) to attach all the positively chargeable silica particles to surfaces of the toner mother particles M1 of the resin-externally-added particles.

Next, a powder obtained by the second mixing step was sifted using a 300-mesh sieve (pore size 48 μm). Through the above, a positively chargeable toner TA-1 was produced. Note that no change in ratio of compositions constituting the toner was observed before and after the sifting.

<Production of Toners TA-2 to TA-8 and TB-1 to TB-4>

Toners TA-2 to TA-8 and TB-1 to TB-4 were produced by the same method as that for producing the toner TA1 in all aspects other than that types of toner mother particles, types of resin particles, and mixing times in the first mixing step were set as shown in Table 1. Each of the toners TA-2 to TA-8 and TB-1 to TB-4 was a positively chargeable toner. Note that the unit of the ASP value shown in Table 1 is "$(cal/cm^3)^{1/2}$". Furthermore, parenthesized signs (P) and (N) in the columns of Toner mother particle and Resin particle in Table 1 each indicate a charge polarity. Each embedment ratio in Table 1 was measured by a method described below.

<Embedment Ratio Measuring Method>

A sample (one of the toners TA-1 to TA-8 and TB-1 to TB-8) was dispersed in a resin ("ARONIX (registered Japanese trademark) D-800", product of Toagosei Co., Ltd.) photocurable by irradiation with visible light, and the resin was hardened by visible light irradiation to obtain a hardened material. Thereafter, the hardened material was sliced at a slicing speed of 0.3 mm/second using a knife for ultrathin piece formation ("SUMI KNIFE (registered Japanese trademark), product of Sumitomo Electric Industries, Ltd., a diamond knife with a blade width of 2 mm and a blade edge angle of 45°) and an ultramicrotome ("EM UC6", product of Leica Microsystems Inc.) to obtain a thin flake having a thickness of 150 nm. The resultant thin flake was dyed through 10-minute exposure to a vapor of an aqueous ruthenium tetroxide solution on a copper mesh. Subsequently, a section of the dyed thin flake sample (section of a toner particle) was captured using a transmission electron microscope (TEM) ("H-7100FA", product of Hitachi High-Technologies Corporation).

The TEM image (a sectional image of the toner particle) captured as above was analyzed using image analysis software ("WinROOF", product of MITANI CORPORATION). Specifically, 10 toner particles were selected at random in the captured TEM image. One resin particle was selected at random from each of the selected toner particles. Then, with respect to each of the selected resin particles, a maximum length $L_A$ of an embedded portion in a radial direction of a corresponding toner mother particle and a maximum length $L_B$ of a protruding portion in the radial direction of the toner mother particle were measured using a measurement tool of the image analysis software. With respect to each of the selected toner particles, the embedment ratio, that is, $L_A/(L_A+L_B)$ was calculated. An arithmetic mean of the measured 10 embedment ratios was taken to be an evaluation value (embedment ratio shown in Table 1) of the sample (toner).

TABLE 1

| Toner | Toner mother particle | Resin particle | Mixing time in first mixing step [minute] | ΔSP value | Embedment ratio |
|---|---|---|---|---|---|
| TA-1 | M1 (N) | P1 (P) | 24.0 | 0.6 | 0.60 |
| TA-2 | M1 (N) | P1 (P) | 31.6 | 0.6 | 0.79 |
| TA-3 | M4 (N) | P1 (P) | 24.0 | 0.8 | 0.60 |
| TA-4 | M4 (N) | P1 (P) | 32.0 | 0.8 | 0.80 |
| TA-5 | M2 (N) | P3 (P) | 24.4 | 0.6 | 0.61 |
| TA-6 | M2 (N) | P3 (P) | 31.6 | 0.6 | 0.79 |
| TA-7 | M3 (N) | P2 (P) | 24.0 | 0.6 | 0.60 |
| TA-8 | M3 (N) | P2 (P) | 32.0 | 0.6 | 0.80 |
| TB-1 | M1 (N) | P1 (P) | 21.2 | 0.6 | 0.53 |
| TB-2 | M1 (N) | P1 (P) | 35.2 | 0.6 | 0.88 |
| TB-3 | M1 (N) | P3 (P) | 24.0 | 0.5 | 0.60 |
| TB-4 | M1 (N) | P4 (N) | 32.0 | 0.6 | 0.80 |

<Preparation of Two-Component Developer>

Raw materials (raw materials of MnO, MgO, $Fe_2O_3$, and SrO) were blended to give the following mole percentages: 39.7% by mole of MnO, 9.9% by mole of MgO, 49.6% by mole of $Fe_2O_3$, and 0.8% by mole of SrO, and water was added to the blended raw materials. Subsequently, the blended raw materials were pulverized for 10 hours using a wet-type ball mill while being mixed. The resultant mixture was then dried. Subsequently, thermal treatment was performed on the dried mixture at a temperature of 950° C. for 4 hours.

Next, the mixture subjected to the thermal treatment was pulverized for 24 hours using a wet-type ball mill to prepare a slurry. Drying and granulation of the obtained slurry were then performed using a spray dryer. Next, the resultant dry granulated product was left to stand for 6 hours in an atmosphere at a temperature of 1,270° C. and an oxygen concentration of 2%, and then deagglomerated. Thereafter, particle size adjustment was performed, whereby a powder of Mn—Mg—Sr ferrite particles (magnetic carrier cores, number average primary particle diameter: 35 μm) having a saturation magnetization of 70 $A \cdot m^2/kg$ in an applied magnetic field of 3,000 ($10^3/4\pi \cdot A/m$) was obtained.

Subsequently, a polyamide-imide resin (a copolymer of a trimellitic anhydride and 4,4'-diaminodiphenylmethane) was diluted with methyl ethyl ketone to prepare a resin solution having a solid concentration of 10% by mass. Next, a tetrafluoroethylene-hexafluoropropylene copolymer (PEP) was dispersed in the resultant resin solution, and a silicon oxide in an amount of 2% by mass relative to a total amount of the resins was further added to the resin solution. Through the above, a carrier coat liquid in an amount of 150 g in terms of solid content was obtained. A mass ratio (polyamide-imide resin:PEP) between polyamide-imide resin and PEP in the obtained carrier coat liquid was 2:8.

Subsequently, 10 kg of the magnetic carrier cores (Mn—Mg—Sr ferrite particles) obtained as described above were coated with the carrier coat liquid using a fluidized bed granulator and coating machine ("SPIRA COTA (registered Japanese trademark) SP-25", product of OKADA SEIKO CO., LTD.). Thereafter, the resultant resin-coated magnetic carrier cores were baked at 220° C. for 1 hour. Through the above, an evaluation carrier was obtained. The amount of the coating resins contained in the evaluation carrier was 1.5% by mass relative to a total amount of the evaluation carrier.

A two-component developer was prepared by mixing 100 parts by mass of the evaluation carrier obtained as above and 8 parts by mass of a toner for evaluation (one of the toners TA-1 to TA-8 and TB-1 to TB-4) together for 30 minutes using a ball mill at a rotational speed of 50 rpm.

<Evaluation of Carrier Contamination>

A color multifunction peripheral ("TASKalfa 5550ci", product of KYOCERA Document Solutions Inc.) was used as an evaluation apparatus. The two-component developer prepared by the above-described method was loaded into a cyan-color development device of the evaluation apparatus. Next, a white image was consecutively output on printing paper (A4 size) for 30 minutes using the evaluation apparatus in an environment at a temperature of 25° C. and a relative humidity of 50% to drive the cyan-color development device of the evaluation apparatus. After the two-component developer was taken out from the cyan-color development device of the evaluation apparatus, toner was sucked and removed from the two-component developer using a 795-mesh sieve (pore size 16 μm) to obtain a carrier for contamination evaluation. For the resultant carrier for contamination evaluation, a GC/MS mass spectrum was plotted through GC/MS analysis. Then, an amount of resin particles attached to the carrier through transfer thereof from the toner to the carrier during the driving of the cyan-color development device (an amount of resin particles transferred to the carrier) was obtained. Conditions for the GC/MS analysis and a method for obtaining an amount of resin particles transferred to the carrier were as described below.

[Conditions for GC/MS Analysis]

Measuring devices used were a gas chromatograph mass spectrometer ("GCMS-QP2010 ULTRA", product of Shimadzu Corporation) and a multi-shot pyrolyzer ("PY-3030D", product of Frontier Laboratories Ltd.). A column used was a GC column ("AGILENT (registered Japanese trademark) J & W ULTRA INERT CAPILLARY GC COLUMN DB-5 ms", product of Agilent Technologies Japan, Ltd., phase: allylene phase having a polymer main chain strengthened by introducing allylene into a siloxane polymer, inner diameter: 0.25 mm, film thickness: 0.25 μm, length: 30 m). With respect to 100 μg of a measurement target (a carrier for contamination evaluation), the GC/MS analysis was performed and a mass spectrum (horizontal axis: mass of ions/number of charged ions, vertical axis: detection strength) having a peak derived from the resin particles was plotted.

Thermal decomposition temperature: Heating furnace "600° C.", interface portion "320° C."

Condition for temperature increase: Increase from 40° C. to 320° C. at a rate of 28° C./minute and keep at 320° C. for 5 minutes.

Carrier gas: Helium (He) gas (linear velocity: 36.1 cm/minute)

Column head pressure: 49.7 kPa.

Injection mode: Split injection (split ratio: 1:200).

Carrier flow rate: Total flow rate "204 mL/minute", column flow rate "1 mL/minute", purge flow rate "3 mL/minute".

[Method for Obtaining Amount of Resin Particles Transferred to Carriers]

An amount of resin particles attached to the carrier for contamination evaluation (amount of resin particles transferred to the carrier) was obtained based on the mass spectrum (mass spectrum by GC/MS method) plotted for the carrier for contamination evaluation by the above-described GC/MS analysis. Specifically, an amount $Y_A$ (unit: g) of resin particles attached to the carrier for contamination evaluation was obtained from an area of a peak derived from the measured resin particles using a pre-plotted calibration curve (a calibration curve showing a relationship between a peak area of a mass spectrum by the GC/NIS method and an amount of attached resin particles). From an amount $Y_B$ (unit: g) of the carrier for contamination evaluation used in the measurement and the amount $Y_A$ of the resin particles thus obtained, an amount $Y_T$ (unit: % by mass) of the resin particles transferred to the carrier was calculated in accordance with an equation "$Y_T=100\times Y_A/Y_B$". An amount $Y_T$ of the resin particles transferred to the carrier being equal to or less than 0.040% by mass was evaluated as "good", and an amount $Y_T$ of the resin particles transferred to the carrier being larger than 0.040% by mass was evaluated as "poor".

<Evaluation of Charge Stability>

[Measurement of Initial Charge Amount]

The two-component developer prepared by the above-described method was left to stand for 24 hours in an environment at a temperature of 25° C. and a relative humidity of 50%. Thereafter, an amount of charge (unit: μC/g) of a toner included in 1.0 the two-component developer was measured using a compact toner draw-off charge measurement system ("MODEL 212HS", product of TREK, INC.) in an environment a temperature of 25° C. and a relative humidity of 50%. In the following, an amount of charge measured herein will be referred to as an "initial charge amount E1" (or simply "E1").

[Measurement of Post-Drive Charge Amount]

A multifunction peripheral ("TASKalfa 5550ci", product of KYOCERA Document Solutions Inc.) was used as an evaluation apparatus. The two-component developer prepared by the above-described method was loaded into a cyan-color development device of the evaluation apparatus. Next, a white image was consecutively output on printing paper (A4 size) for 30 minutes using the evaluation apparatus in an environment at a temperature of 25° C. and a relative humidity of 50% to drive the cyan-color development device of the evaluation apparatus. Subsequently, the two-component developer was taken out from the cyan-color development device of the evaluation apparatus and the amount of charge (unit: μC/g) of a toner included in the taken-out two-component developer was measured using a compact toner draw-off charge measurement system ("MODEL 212HS", product of TREK, INC.) in an environment at a temperature of 25° C. and a relative humidity of 50%. In the following, an amount of charge measured herein will be referred to as a "post-drive charge amount E2" (or simply "E2").

[Calculation of Charge Amount Change]

A charge amount change (unit: μC/g) was obtained from the measured initial charge amount E1 and the measured post-drive charge amount E2 based on the following equation. The charge amount change is a difference (absolute value) between E1 and E2.

$$\text{Charge amount change}=|E1-E2|$$

When the charge amount change was equal to or smaller than 2 μC/g, charge stability was evaluated as good. By contrast, when the charge amount change was larger than 2 μC/g, charge stability was evaluated as poor.

<Evaluation of Heat-resistant Preservability>

First, 3 g of a toner (one of the toners to be evaluated) was placed in a polyethylene container (capacity: 20 mL) and then the polyethylene container was sealed. The sealed container was tapped for 5 minutes and then left to stand for 8 hours in a thermostatic chamber set at 60° C. Thereafter, the toner was taken out from the container and cooled to room temperature (25° C.), whereby an evaluation target was obtained.

The obtained evaluation target was placed on a 300-mesh sieve (pore size: 48 μm) of a known mass. A mass of the sieve including the evaluation target placed thereon was measured to obtain a mass of the toner before sifting. The sieve was then set on a powder property evaluation machine ("POWDER TESTER (registered Japanese trademark) PT-X", product of Hosokawa Micron Corporation), and the evaluation target was sifted by shaking the sieve at an amplitude of 1.0 mm for 30 seconds in accordance with a manual of the powder property evaluation machine. A mass of toner that had not passed through the sieve was measured after the sifting. An agglomeration rate (unit: % by mass) was calculated from the mass of the toner before sifting and the mass of the toner after sifting in accordance with an expression shown below. A case of an aggregation rate of equal to or lower than 9% by mass was evaluated as excellent in heat-resistant preservability. By contrast, a case of an aggregation rate of higher than 9% by mass was evaluated as poor in heat-resistant preservability. Note that "mass of toner after sifting" in the following expression means a mass of toner that had not passed through the sieve and remained on the sieve after the sifting.

$$\text{Agglomeration rate}=100\times(\text{mass of toner after sifting}/\text{mass of toner before sifting})$$

<Evaluation Results>

With respect to each of the toners TA-1 to TA-8 and TB-1 to TB-4, an amount $Y_T$ of resin particles transferred to the carrier, evaluation results of charge stability, and an aggregation rate are shown in Table 2. Note that "Transfer amount $Y_T$" in Table 2 refers to an amount $Y_T$ of resin particles transferred to the carrier.

TABLE 2

| | | | Evaluation results of charge stability | | | |
|---|---|---|---|---|---|---|
| | Toner | Transfer amount $Y_T$ [% by mass] | E1 [μC/g] | E2 [μC/g] | Charge amount change [μC/g] | Agglomeration rate [% by mass] |
| Examples 1 | TA-1 | 0.021 | 31 | 29 | 2 | 6 |
| Examples 2 | TA-2 | 0.014 | 30 | 30 | 0 | 3 |
| Examples 3 | TA-3 | 0.032 | 31 | 29 | 2 | 9 |
| Examples 4 | TA-4 | 0.024 | 31 | 29 | 2 | 7 |
| Examples 5 | TA-5 | 0.023 | 30 | 30 | 0 | 7 |
| Examples 6 | TA-6 | 0.017 | 31 | 29 | 2 | 4 |
| Examples 7 | TA-7 | 0.022 | 31 | 29 | 2 | 6 |
| Examples 8 | TA-8 | 0.018 | 30 | 29 | 1 | 5 |
| Comparative Examples 1 | TB-1 | 0.043 | 30 | 26 | 4 | 14 |
| Comparative Examples 2 | TB-2 | 0.010 | 31 | 27 | 4 | 10 |
| Comparative Examples 3 | TB-3 | 0.012 | 31 | 28 | 3 | 18 |
| Comparative Examples 4 | TB-4 | 0.060 | 31 | 25 | 6 | 22 |

Each of the toners TA-1 to TA-8 Had the above-described basic composition. Specifically, each of the toners TA-1 to TA-8 included toner particles each including a toner mother particle containing a binder resin and an external additive attached to the toner mother particle. In each of the toners TA-1 to TA-8, the external additive included resin particles. As shown in Table 1, the toner mother particles of each of the toners TA-1 to TA-8 had a chargeability opposite to the chargeability of the resin particles. Each of the toners TA-1 to TA8 had an embedment ado of at least 0.60 and no greater than 0.80. Each of the toners TA-1 to TA-8 had a ΔSP value of at least 0.6 $(\text{cal/cm}^3)^{1/2}$.

As shown in Table 2, each of the toners TA-1 to TA-8 had a charge amount change of no greater than 2 μC/g. Each of the toners TA-1 to TA-8 was thus excellent in charge stability. Each of the toners TA-1 to TA-8 had an aggregation rate of no greater than 9% by mass. This indicated excellent heat-resistant preservability of the toners TA-1 to TA-8.

As shown in Table 1, the toner TB-1 had an embedment ratio of less than 0.60. The toner TB-2 had an embedment ratio of greater than 0.80. The toner TB-3 had a ΔSP value of less than 0.6 $(cal/cm^3)^{1/2}$. In the toner TB-4, both the toner mother particles and the resin particles had a negative chargeability.

As shown in Table 2, each of the toners TB-1 to TB-4 had a charge amount change of greater than 2 μC/g. This indicated poor charge stability of the toners TB-1 to TB-4. The toners TB-1 to TB-4 had an aggregation rate of greater than 9% by mass. This indicated poor heat-resistant preservability of the toners TB-1 to TB-4.

From the above results, it was shown that a toner excellent in charge stability and heat-resistant preservability can be provided according to the present disclosure.

What is claimed is:

1. A toner comprising toner particles, wherein the toner particles each include a toner mother particle containing a binder resin and an external additive attached to the toner mother particle, the external additive includes resin particles, the toner mother particles have a chargeability opposite to a chargeability of the resin particles, each of the resin particles has an embedded portion embedded in a surface portion of the toner mother particle and a protruding portion protruding outward from the toner mother particle in a radial direction of the toner mother particle, in a cross section of the resin particle, a relationship $0.60 \leq LA/(LA+L_B) \leq 0.80$ is satisfied where $L_A$ represents a maximum length of the embedded portion in the radial direction of the toner mother particle and $L_B$ represents a maximum length of the protruding portion in the radial direction of the toner mother particle, a relationship $|SP_r - SP_E| \geq 0.6$ $(cal/cm^3)^{1/2}$ is satisfied where $SP_T$ represents an SP value of the binder resin contained in the toner mother particles and $SP_E$ represents an SP value of a resin constituting the resin particles, the toner mother particles contain a polyester resin as the binder resin, the resin constituting the resin particles is a cross-linked resin, and the cross-linked resin is a polymer of styrene, (meth) acrylic acid alkyl ester, and a cross-linking agent having two or more unsaturated bonds.

2. The toner according to claim 1, wherein the resin particles have a number average primary particle diameter of at least 60 nm and no greater than 140 nm.

3. The toner according to claim 1, wherein the resin particles are included in an amount of at least 0.2 parts by mass and no greater than 1.0 parts by mass relative to 100 parts by mass of the toner mother particles.

4. The toner according to claim 1, wherein the cross-linking agent having the two or more unsaturated bonds is ethylene glycol dimethacrylate.

5. The toner according to claim 1, wherein the relationship $|SP_r - SP_E|$ is no greater than 0.8 $(cal/cm^3)^{1/2}$.

6. The toner according to claim 1, wherein the toner mother particles have a negative chargeability, and the resin particles have a positive chargeability.

7. A toner comprising toner particles, wherein the toner particles each include a toner mother particle containing a binder resin and an external additive attached to the toner mother particle, the external additive includes resin particles, the toner mother particles have a chargeability opposite to a chargeability of the resin particles, each of the resin particles has an embedded portion embedded in a surface portion of the toner mother particle and a protruding portion protruding outward from the toner mother particle in a radial direction of the toner mother particle, in a cross section of the resin particle, a relationship $0.60 \leq LA/(LA+L_B) \leq 0.80$ is satisfied where LA represents a maximum length of the embedded portion in the radial direction of the toner mother particle and $L_B$ represents a maximum length of the protruding portion in the radial direction of the toner mother particle, a relationship $|SP_r - SP_E| \geq 0.6$ $(cal/cm^3)$" " is satisfied where $SP_T$ represents an SP value of the binder resin contained in the toner mother particles and $SP_E$ represents an SP value of a resin constituting the resin particles, the toner mother particles have a negative chargeability, the resin particles have a positive chargeability, and the resin particles each include a cross-linked resin base and a cationic surfactant attached to a surface of the cross-linked resin base.

* * * * *